US005724963A

United States Patent [19]

Seeley

[11] Patent Number: 5,724,963

[45] Date of Patent: Mar. 10, 1998

[54] PORTABLE AIR RESPIRATOR

[76] Inventor: Larry E. Seeley, 4228 Marine Pkwy., New Port Richey, Fla. 34652

[21] Appl. No.: 549,298

[22] Filed: Oct. 27, 1995

[51] Int. Cl.[6] ..... A62B 18/10

[52] U.S. Cl. ..... 128/206.15; 128/205.27; 128/205.24

[58] Field of Search ..... 128/205.27, 205.12, 128/205.24, 206.15

[56] References Cited

U.S. PATENT DOCUMENTS

| | | | |
|---|---|---|---|
| 2,775,968 | 1/1957 | Polli et al. | 128/205.12 |
| 4,488,547 | 12/1984 | Mason | 128/202.22 |
| 4,489,721 | 12/1984 | Ozaki et al. | 128/205.24 |
| 4,643,182 | 2/1987 | Klein | 128/201.25 |
| 4,649,912 | 3/1987 | Collins | 128/205.12 |
| 4,686,976 | 8/1987 | Bakkila et al. | 128/206.15 |
| 5,027,810 | 7/1991 | Patureau et al. | 128/206.24 |
| 5,038,768 | 8/1991 | McGoff et al. | 128/202.26 |
| 5,054,481 | 10/1991 | Shin | 128/205.12 |
| 5,315,987 | 5/1994 | Swann | 128/201.25 |

FOREIGN PATENT DOCUMENTS

| | | | |
|---|---|---|---|
| 3937513 | 5/1991 | Germany | 128/205.24 |

*Primary Examiner*—Edgar S. Burr
*Assistant Examiner*—Daniel J. Colilla
*Attorney, Agent, or Firm*—Donald C. Casey

[57] ABSTRACT

A portable filter for a compressed air system is described. The filter is intended to be worn by an operator, and contains a diverter valve whereby air from a remote air compressor enters the filter, and is divided into a flow to a work line, and a regulated flow to a conventional respirator mask to provide breathing air to the operator. The air diverted to the operator passes through a three-stage filter consisting of elements in series which are designed to both remove impurities from the air, and register excessive moisture content therein as a warning to the operator. The flow to the work line is typically a five foot line to an air-driven implement such as a paint sprayer or the like.

14 Claims, 3 Drawing Sheets

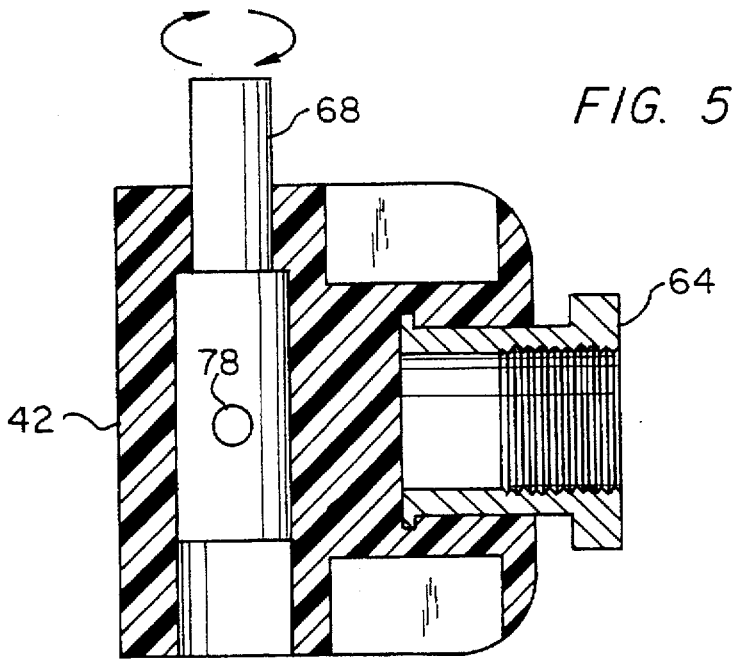
FIG. 5
FIG. 4
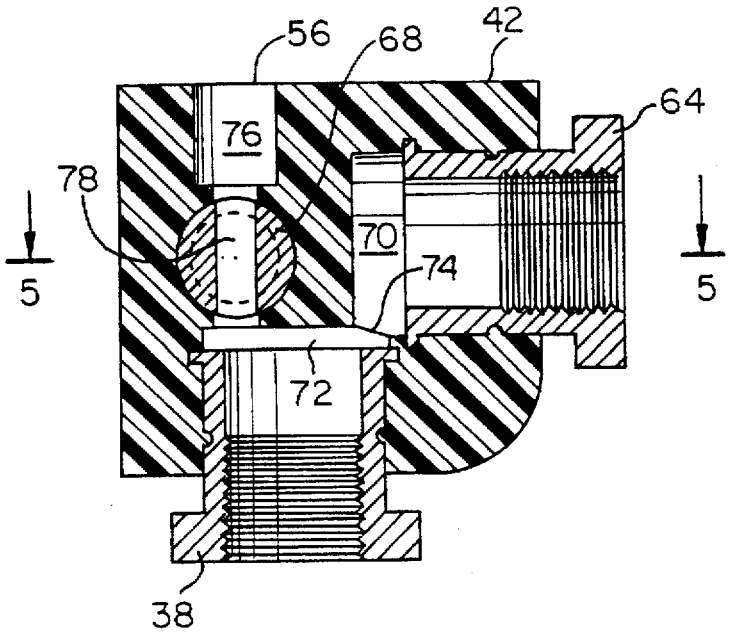

PORTABLE AIR RESPIRATOR

FIELD OF THE INVENTION

This invention relates to a portable respirator, and in particular to a filter device which is carried by the user and which admits a controlled flow of air from an air compressor into the respirator and diverts the flow of that air into a hand-held work line.

DESCRIPTION OF THE PRIOR ART

It is well known that in numerous construction or industrial situations it is necessary to use a source of compressed air to drive a particular implement or machine, and that this operation must be controlled by one or more individuals. It is also well known that when such machines are in use the ambient atmosphere typically is not breathable due to films, particles, and dust generated. For example, typically in an industrial painting situation, a paint sprayer operated by a source of compressed air will be controlled by an individual and the ambient atmosphere during painting operation is not breathable due to particles of the paint which are released into the atmosphere by the sprayer.

In such a situation, it is normally not sufficient merely to breathe the ambient atmosphere through a filter. Worker safety rules generally require an independent source of air to be breathed which does not originate within the immediate proximity of the object or objects being painted.

It is also not feasible in most industrial applications to supply the worker with a self-contained source of air to be breathed. Typically the tank would restrict the movement of the workmen and would be heavy.

In U.S. Pat. No. 5,054,481, there is described a breathing system for use with an air hammer typically in a rock drilling situation. The operator wears a respirator mask which is supplied with breathable air from the source of compressed air which in turn drives the rock hammer. As described therein, air is diverted from the compressor line to the rock hammer through two carbon filters and admitted to the respirator mask. The diverter valve is carried by the hammer, and is controllable to increase or decrease the flow therethrough. Problems associated with this type of device are several. For example, the air from an air compressor is typically quite warm, up to 100° F. and, therefore, when it is diverted to the mask it will cause the user discomfort. In addition, if the user leaves the air hammer such as to go on break, he must disconnect his filter line from the compressor line in order to leave the general area. In this event, as he leaves the area he has no source of breathable air.

In U.S. Pat. No. 4,258,710, compressed air is admitted directly to the respirator mask. A baffle system is provided, but a filter is not provided for the air. Compressors are supposed to have anti-moisture devices on them so that moisture will not flow through the compressor line. In the absence of a filter, there is no ability to determine whether moisture is in fact passing through the air line. In addition, as noted above, there is no means for regulating the temperature of the air admitted from the air compressor when it is admitted directly to the respirator mask.

SUMMARY OF THE INVENTION

It has been discovered, however, that a highly effective portable respirator can be provided wherein an effective filter system is carried by the wearer attached to, for example, a belt. Air is admitted to the filter system through a diverter valve and which controls the flow therethrough and also diverts a portion of that flow to a separate work line which would, in turn, drive an implement such as a compressed air paint sprayer or similar device. The source of compressed air then is directly admitted to the valve and from the valve in a bifurcated flow to the mask and to a work line which is hand-held by the operator. If it is desired to terminate the use of the implement, then the hand-held work line can be quickly detached from the portable filter.

The filter system provides three stages which are in series, each stage being a separate module filter element. In the first stage, a window is provided and a moisture indicator is also provided so that the operator can determine if the air compressor is not sending dry air into the line. When the air exits the third stage, it proceeds to a conventional respirator mask where it is admitted for breathing.

It has been found that the circuitous passage through the portable filter of this invention including passage through nozzles in the path of the compressed air, results in a substantial lowering of the temperature of the air admitted to the respirator mask of from 10 to 20 degrees, typically.

Accordingly, it is an object of this invention to provide a portable respirator device which includes a filter element which is adapted to be worn by an operator and which provides a means at the filter for diverting a flow of compressed air from an air compressor to a first stream which is filtered for breathing and to a second stream which is not filtered but directed through a work line to an implement to be driven.

It is another object of this invention to provide a diverter valve for a portable air respirator filter wherein the flow of air through the filter system to be breathed can be controlled as to the magnitude of the flow without specifically regulating the air flow diverted thereby to a work line.

It is a further object of this invention to provide a portable respirator system, including a three stage filter for air from an air compressor wherein the first stage is a carbon filter equipped with moisture indicator, the second filter is a molecular sieve, and the third filter is a catalyst designed to eliminate hydrocarbons and the like such as oil mist.

It is yet another object of this invention to provide a unique portable filter system for air from an air compressor wherein the compressed air passes through three stages; the first stage filters odors, oil mist, moisture, hydrocarbons and dust particles with carbon, and the second stage continues this filtration but also filters carbon dioxide, and the third stage removes both hydrocarbons and carbon monoxide from the air to be breathed.

These and other objects will become readily apparent with reference to the drawings and following description.

BRIEF DESCRIPTION OF DRAWINGS

FIG. 4 is a vertical cross-sectional rear view of the diverter valve shown in FIGS. 2 and 3; and FIG. 5 is a cross-sectional view taken along lines 5—5 of FIG. 4.

DETAILED DESCRIPTION OF THE PREFERRED EMBODIMENT

Figure 1:
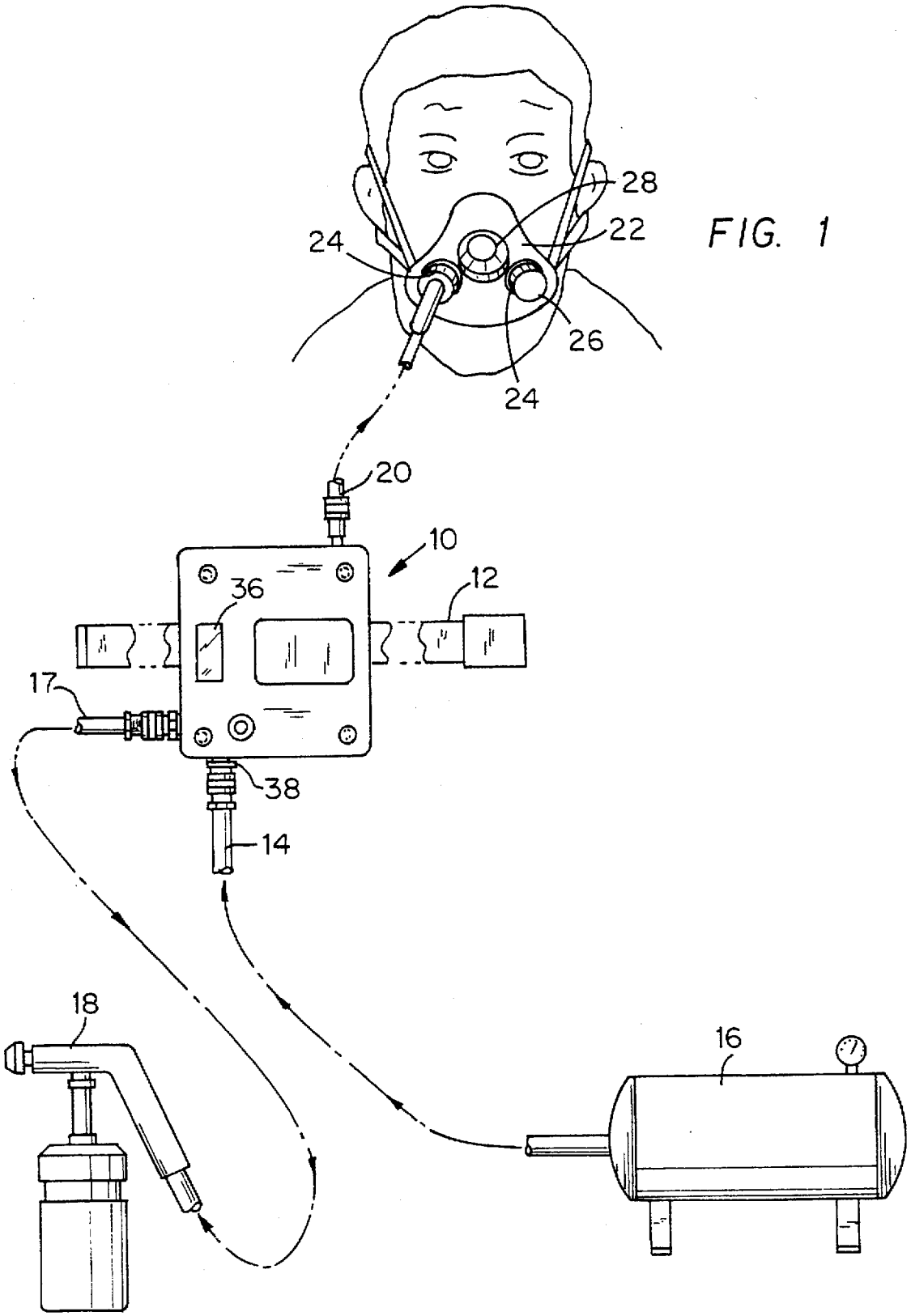
FIG. 1 is a stylized schematic view of the device of this invention as worn by an operator.

With attention to FIG. 1, the portable air filter of this invention 10 is intended to be worn on the belt 12 of the user and is supplied by a line 14 from a remote air compressor 16. Compressed air enters the filter system 10 through line 14 and is continually diverted through a work line 17 to a remote air driven implement 18. In this instance, a paint sprayer is shown, however, the implement 18 could be any device from a paint roller to an air hammer. The line 17 preferably is about 5 feet long. Filtered air exits the device 10 into a line 20 which, in turn, is connected to a conventional respirator mask 22. Mask 22 is fitted with inlets 24 on either side, and the inlet not in use is covered by a cap 26. The air is exhaled through a one-way valve 28 of conventional design.

Figure 2:
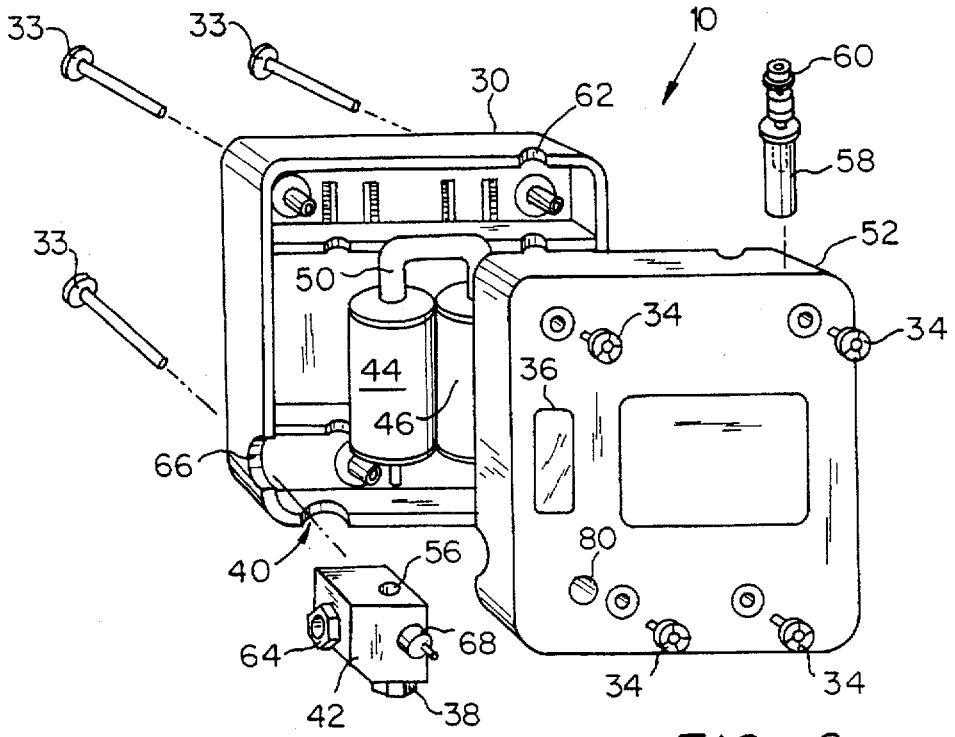
FIG. 2 is a front exploded view of the portable filter of this invention.
Figure 3:
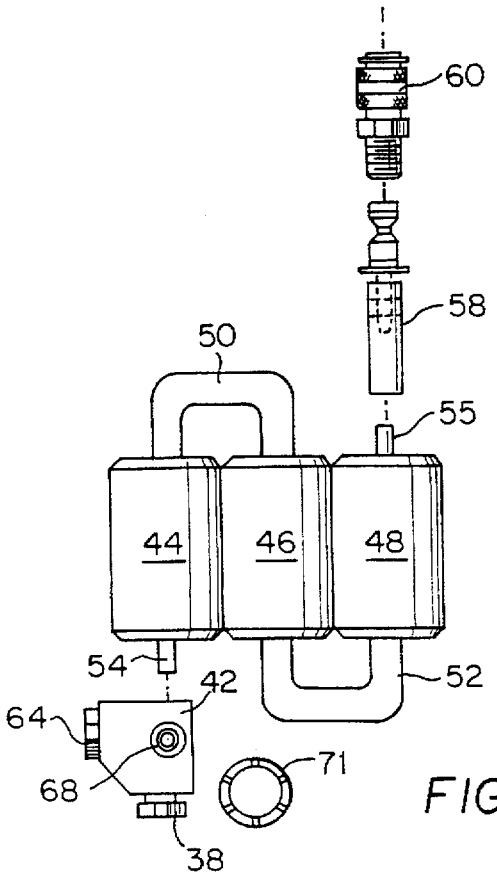
FIG. 3 is a front exploded view of the filter of this invention with the housing removed.

With attention to FIGS. 2 and 3, the respirator filter of this invention 10 includes a two-piece housing having a back portion 30 and a front portion 32. The two portions are typically bolted together with aluminum posts 33 which extend through holes in back cover 30 and are engaged at the front cover by screws 34. The housing covers 30 and 32 typically are plastic. Furthermore, a window 36 is provided in the front cover, as will be subsequently explained. Air from the compressor line 14 passes through a brass bushing 38 at inlet port 40 and into a diverter valve 42 mounted within the housing 10. Bushing 38 then serves to anchor valve 42 within the housing 10.

Three filters 44, 46 and 48 are disposed within the housing and are interconnected by U-shaped conduits 50, between the outlet of filter 44 and the inlet of filter 46 and conduit 52 between the outlet of filter 46 and the inlet to filter 48 so that the filters are disposed in series. The inlet to filter 44 includes a conduit portion 54 which engages the diverter valve outlet 56 and is typically press fit therein. Air from the compressor 16 then passes through line 14, valve 42, and through conduit 54 into the filter system.

The outlet from filter 48 is a conduit 55 which, in turn, mounts a plastic spool 58. A brass nipple 60 is provided downstream of spool 58. Therefore, the outlet from filter 48 passes through spool 58 and through the outlet 62 in housing 10 and thereby through the brass nipple 60 into the respirator line 20 which is connected to the respirator mask inlet 24.

Diverter valve 42 further includes a second bushing 64 which extends through the work line outlet 66 in the housing 10 and mounts the work line 16 which connects, through valve 42, the compressor 16 and the work implement 18.

As will be subsequently described, valve 42 is controlled through a stem valve 68 which has a manual knob 71 attached externally thereto so that rotation of the stem 68 will regulate the flow through the diverter valve outlet 56.

With attention to FIGS. 4 and 5, the valve 42 includes internal bores 70 and 72 which receive, respectively, bushings 64 and 38. Bores 70 and 72 intersect at a juncture 74 so that the bores are in communication continually.

The valve 42 also defines a passage 76 which is circular in cross section and extends from the bore 72 to the outlet port 56. The rotatable stem valve 68 is disposed at right angles to this passage as shown in FIG. 5. Stem 68 includes a passageway 78 which extends the diameter of the stem 68 as shown in FIG. 4. When the passage 78 is aligned between the bore 72 and the passage 76, air from the compressor line 14 will proceed through the passageways and exit port 56 into the first filter 44. In addition, as the stem is rotated, as shown in FIG. 5, the flow through passage 78 will be changed so that the flow ultimately from the compressor 16 to the wearer's mask 22 can be controlled by rotation of the stem 68 and, in turn, by rotation of the knob thereon 70. Knob 70 is disposed on the front face of the front portion of the housing 32 so that it may be easily grasped by the operator. To that end, an opening 80 is provided in the front housing portion 32 through which the stem 68 extends.

As best shown in FIG. 4, valve 42 has a built-in safety feature to ensure that the compressor line 14 is attached at bushing 38 rather than at the outlet bushing 64 intended for the workline 16. Bore 72 has a longitudinal axis which is parallel to the longitudinal axis of passage 76. In contrast, bore 70, which is intended as an outlet for the work line 16, has an axis perpendicular to the axis of inlet bore 72. When compressed air enters bore 72, it proceeds directly through passage 76 and is diverted into bore 70 as an outlet. However, if the line from the compressor 14 is mistakenly attached at bushing 64, the air will enter bore 70 and be deflected into bore 72 whereby it will be expelled, thereby creating a vacuum in passage 76. In this way, an operator will know immediately if he has connected the compressor line 14 incorrectly to bushing 64.

The three-stage filter of this invention also is intended to include a means for determining when water is present in the compressor line 14. To that end, the window 36 provided in housing 10 is aligned with the first filter 44. Filter 44 typically is formulated from a cylinder of clear plastic and a paper indicator (not shown) is provided lining the interior wall of the cylinder. When moisture enters the filter 44, the paper then will turn a characteristic color such as green, which can be then observed through the window 36 by the wearer.

The filters 44, 46 and 48 are intended to be plastic cylinders which contain filter material therein. In the preferred embodiment of this invention, filter 44 is a carbon filter whereas filter 46 is a molecular sieve and filter 48 is a catalyst designed to remove hydrocarbons and the like. The carbon filter in filter 44 is intended to remove odors and, to a certain extent, oil mists and hydrocarbons as well as moisture and dust particles. Filter 46 is intended to remove these same impurities plus carbon dioxide. Finally, in filter 48, hydrocarbons are removed, but also carbon monoxide is removed by oxidizing it to a carbon dioxide.

In the preferred embodiment of this invention, as noted above, filter 44 contains activated carbon, a conventional filter material, and conventional paper moisture indicator is provided surrounding the internal surface of the clear plastic cylinder 44. The molecular sieve disposed in second stage filter 46 is preferably a pellet-like material which can be purchased from Union Carbide Company, and it is identified as a conventional molecular sieve material. The third stage filter 48 preferably contains the catalyst zinc chromate. A preferred catalyst is marketed under the trade name Carulite by Carus Chemical Company of Ottawa, Ill. As will be obvious to those skilled in the art, the filter material itself is known to those skilled in the art and equivalent or similar materials are intended to be substituted as needed.

As will be obvious to those skilled in the art, the use of an air compressor 16 as a source of breathable air involves the problem that air from a compressor typically is very warm and may be at a temperature of about 100° F. Air at this temperature entering the respirator mask 22 would cause a great deal of wearer discomfort. As is evident, however, from the drawings when the air passes through the respirator 10, it also passes through a number of constrictions and structural features which do function as nozzles. For example, as shown in FIG. 4, for example, the air after passing through stem valve channel 78 expands into passage 76 and each expansion will result in cooling. The brass nipple 60, for example, receives a nozzle which functions as a venturi throat which is a portion of the spool 58.

Furthermore, the passage through the filter elements 44, 46 and 48, can result in cooling of the air. In any event, the air entering the mask 22 has been found to be at least about 20° cooler than the air entering the respirator device 10. In use device 10 includes typically belt clips (not shown) which are disposed on the back of the back portion 30 of the housing of respirator 10. As indicated above, the work line 16 typically is about 5 feet long. The operator then does not have to carry a separate work line, but only a single conduit extends from the compressor 16 to the operator. Air from the compressor 16 is continually diverted through valve 42 from the inlet bore 72 to the outlet bore 70, and this is not controlled by the stem valve 68. The stem valve 68 only regulates the flow through the filter system 10 of this invention to the mask 22. If the user, for example, goes on break, the implement 18 and its line 17 can be removed from bushing 64 and left in place while the operator exits the work area and, at the same time, has a source of breathable air from compressor 16. When work is to be resumed, the operator merely enters the room and reattaches line 16 at bushing 64. The operator then only has to deal with a single conduit from the compressor and does not have to deal with a separate line from the compressor to the implement 18.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

I claim:

1. A portable respirator system for use in combination with a source of compressed air and a hand-held, air-driven work implement to provide breathable air to an operator of said implement when driven by said source of compressed air, the improvement comprising:

a respirator mask having an inlet for breathable air and an outlet for exhalation adapted to be worn by said operator said inlet having no filter therein and no filter being carried by said mask;

a filter system comprising a housing adapted to be carded by an operator and having a first outlet port in communication with the inlet to said mask, a second outlet port adapted to be operably coupled to a work implement and an inlet port adapted to be coupled to and to receive compressed air from said source thereof;

carrying means, separate from said mask, for releasably attaching said housing to said operator;

diverter valve means disposed in said housing coupled to said inlet port for continually diverting a flow of compressed air from said source to said second outlet port, and for directing a predetermined controlled flow of compressed air to said first outlet port and further including cooling means for cooling said predetermined flow; and filter means disposed in said housing between said valve means and first outlet port for receiving the predetermined flow, filtering the same and expelling the filtered flow into said first outlet port.

2. The system of claim 1 wherein said filter means includes three filter elements disposed in series.

3. The system of claim 2 wherein the first element includes means for identifying a predetermined moisture content in said flow.

4. The system of claim 3 wherein the first filter element is activated carbon.

5. The system of claim 4 wherein the second filter element is a molecular sieve.

6. The system of claim 5 wherein the third filter element is a catalyst for removing hydrocarbons and carbon monoxide from said flow.

7. The filter of claim 6 wherein the catalyst includes zinc chromate.

8. The system of claim 1 wherein said valve means includes regulator means for manually controlling the flow to said first outlet.

9. The valve means of claim 8 wherein a passage is defined between said inlet port and said first outlet port and a rotatable valve stem having an opening therethrough is provided extending diametrically through said passage, the opening being aligned with said passage whereby rotation of the stem will regulate the size of said opening disposed in said passage.

10. The diverter valve means of claim 9 wherein the passage includes an upstream bore aligned with said inlet port, and a downstream portion aligned with said first outlet port, the longitudinal axes of said bore and downstream portion being parallel.

11. The valve means of claim 10 further comprising a diverter bore opening into said second outlet port and communicating with the inlet port through said upstream bore.

12. The valve means of claim 11 wherein the longitudinal axis of said diverter bore is perpendicular to the longitudinal axis of said upstream bore.

13. The valve means of claim 11 wherein the downstream passage portion is downstream of said valve stem and the upstream bore is upstream thereof.

14. The filter system of claim 1 wherein said cooling means includes nozzle means for cooling said predetermined flow of compressed air therethrough.

* * * * *